United States Patent [19]

Niino et al.

[11] Patent Number: 4,520,642

[45] Date of Patent: Jun. 4, 1985

[54] CONTROL DEVICE FOR CONTINUOUS ROLLING MACHINE

[75] Inventors: Shuheu Niino; Koichi Ishimura; Ken Okamoto; Koichi Ohba, all of Hyogo, Japan

[73] Assignee: Mitsubishi Denki Kabushiki Kaisha, Tokyo, Japan

[21] Appl. No.: 425,792

[22] Filed: Sep. 28, 1982

[30] Foreign Application Priority Data

Sep. 30, 1981 [JP] Japan ..... 56-157218
Sep. 30, 1981 [JP] Japan ..... 56-157219
Sep. 30, 1981 [JP] Japan ..... 56-157220

[51] Int. Cl.[3] ..... B21B 37/12

[52] U.S. Cl. ..... 72/8; 72/11; 72/16; 72/205; 72/235; 364/472

[58] Field of Search ..... 72/16, 12, 235, 8, 9, 72/11, 205; 364/472

[56] References Cited

U.S. PATENT DOCUMENTS 3,526,113 9/1970 McNaugher ..... 72/16 X
3,650,135 3/1972 Skelton et al. ..... 72/16 X
3,760,621 9/1973 Fujii et al. ..... 72/12
3,798,940 3/1974 Frostick ..... 72/8
3,841,124 10/1974 Shida et al. ..... 72/17

FOREIGN PATENT DOCUMENTS 122615 9/1980 Japan .
55-122616 11/1980 Japan .

*Primary Examiner*—Francis S. Husar
*Assistant Examiner*—Steven B. Katz
*Attorney, Agent, or Firm*—Sughrue, Mion, Zinn, Macpeak, and Seas

[57] ABSTRACT

A control device for a continuous rolling machine effects feedback control by measuring vertical and lateral dimensions at a point after an ith mill stand, and by controlling the tension in the material between an i−1th and the ith mill stand and the position of the ith mill stand to reduce the differences between the detected dimensions and reference dimensions to zero. A shape correction device may be used which calculates lateral and vertical dimension change values for the i−1th stand, which are used to control the position of the i−1th stand and the tension in the material between an i−2th mill stand and the i−1th stand to assist in bringing the actual dimensional output values into coincidence with the reference values.

4 Claims, 6 Drawing Figures

CONTROL DEVICE FOR CONTINUOUS ROLLING MACHINE

BACKGROUND OF THE INVENTION

This invention concerns the dimension control of the rolling material of a continuous rolling machine having a hole roll, for example, a bar steel mill or a wire mill.

An example of the structure of a continuous rolling machine of this type is shown in FIG. 1.

FIG. 1 shows a continuous rolling machine comprising i mill stands, wherein are illustrated a #1 mill stand 1, a #2 mill stand 2, an #i−1 mill stand 3, an #i mill stand 4, and a rolling material 5.

FIG. 1 illustrates a so-called VH type rolling machine, wherein horizontal mill stands (odd numbered stands in FIG. 1) and vertical mill stands (even numbered stands in FIG. 1) are alternately arranged.

For instance, the #i−1 mill stand 3 is a vertical mill performing rolling in the X direction wherein bi−1 represents the laterial dimension and hi−1 represents the vertical dimension at the exit of the #i−1 mill stand 3. On the other hand, the #i mill stand 4 is a horizontal mill performing rolling in the Y direction, wherein bi represents the lateral dimension and hi represents the vertical dimension at the exit of the #i mill stand 4.

Conventional continuous rolling machines such as bar steel and wire mills employ a non-tension control method (AMTC) for reducing the tension between the mill stands to zero. However, a dynamic control method has not yet been used for the following reasons.

(1) there have been no severe requirements on the dimension of the products, and (2) mill elongation due to a change in the load during rolling is small (which makes the dimensional accuracy of the products better, since the effect of transferring the change at the inlet to the exit is decreased).

Accordingly, no particular control has been exercised in the conventional control system over the change in dimensions relative to changes in the temperature of the rolling material or the like, worsening the dimensional accuracy.

SUMMARY OF THE INVENTION

This invention has been made in view of the foregoing drawbacks, and it is an object thereof to perform rolling with high dimensional accuracy by detecting the lateral dimension of a material at the exit of an ith mill stand and by controlling the tension of the material between an i−1th mill stand and the ith mill stand so that the difference between the detected dimension and a reference lateral dimension is reduced to zero.

Another object of this invention is to perform smooth rolling with high dimensional accuracy by performing control as described above, as well as by calculating a change value in the dimension at the i−1th mill stand and controlling the rolling position of the i−1th mill stand and the tension of the material between an i−2th mill stand and the i−1th mill stand.

It is a further object of the invention to attain rolling with an extremely high dimensional accuracy by detecting the vertical and lateral dimensions of a material at the exit of an ith mill stand, and controlling the rolling position of the ith mill stand and the tension between the i−1th mill stand and ith mill stand so that the detected values agree with a reference lateral dimension, while, at the same time, calculating such a change value in the vertical and the lateral dimensions as will render the vertical dimension and the lateral dimension of the material at the exit of the ith mill stand to be identical with the reference values, and by controlling the rolling position of the i−1th mill stand and the tension between an i−2th mill stand and the i−1th mill stand in accordance with the calculated values.

It is a still further object of this invention to perform rolling with high accuracy by measuring the vertical dimension of a material at the exit of the ith mill stand and controlling the rolling position of the ith mill stand so as to equate the measured dimension with a reference dimension while, at the same time, adjusting the change in the lateral dimension of the material resulting from the above control by controlling the inter-stand tension upstream of the ith mill stand.

Another object of this invention is to moderate the increase in the control value for the ith mill stand resulting from the above control, by controlling the rolling position of an i−1th mill stand and the inter-stand tension upstream of the i−1th mill stand.

DETAILED DESCRIPTION OF THE PREFERRED EMBODIMENTS

Figure 1:
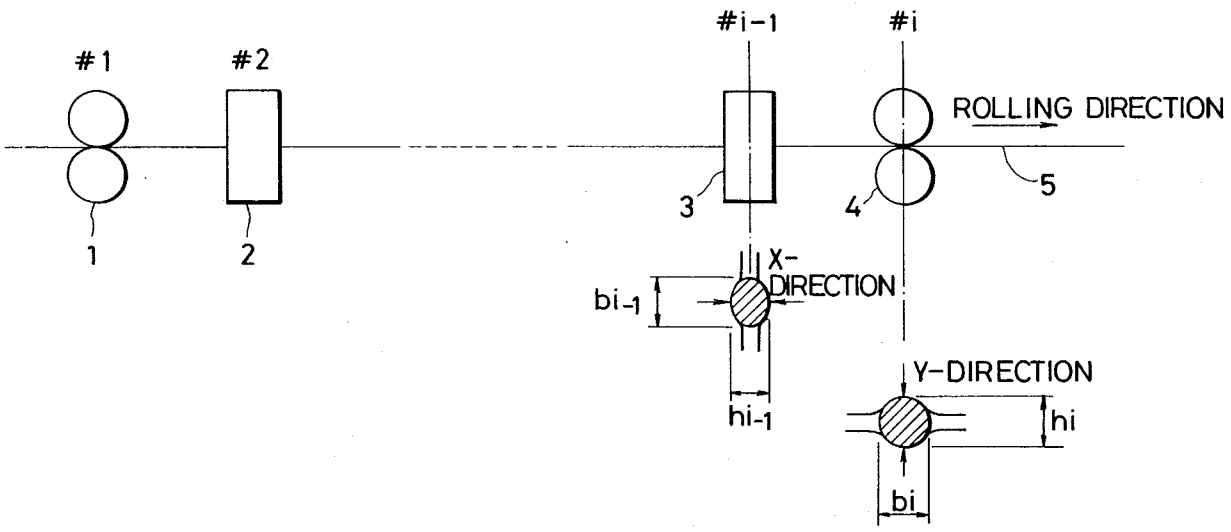
FIG. 1 is a schematic view for one example of a conventional continuous rolling mill.
Figure 2:
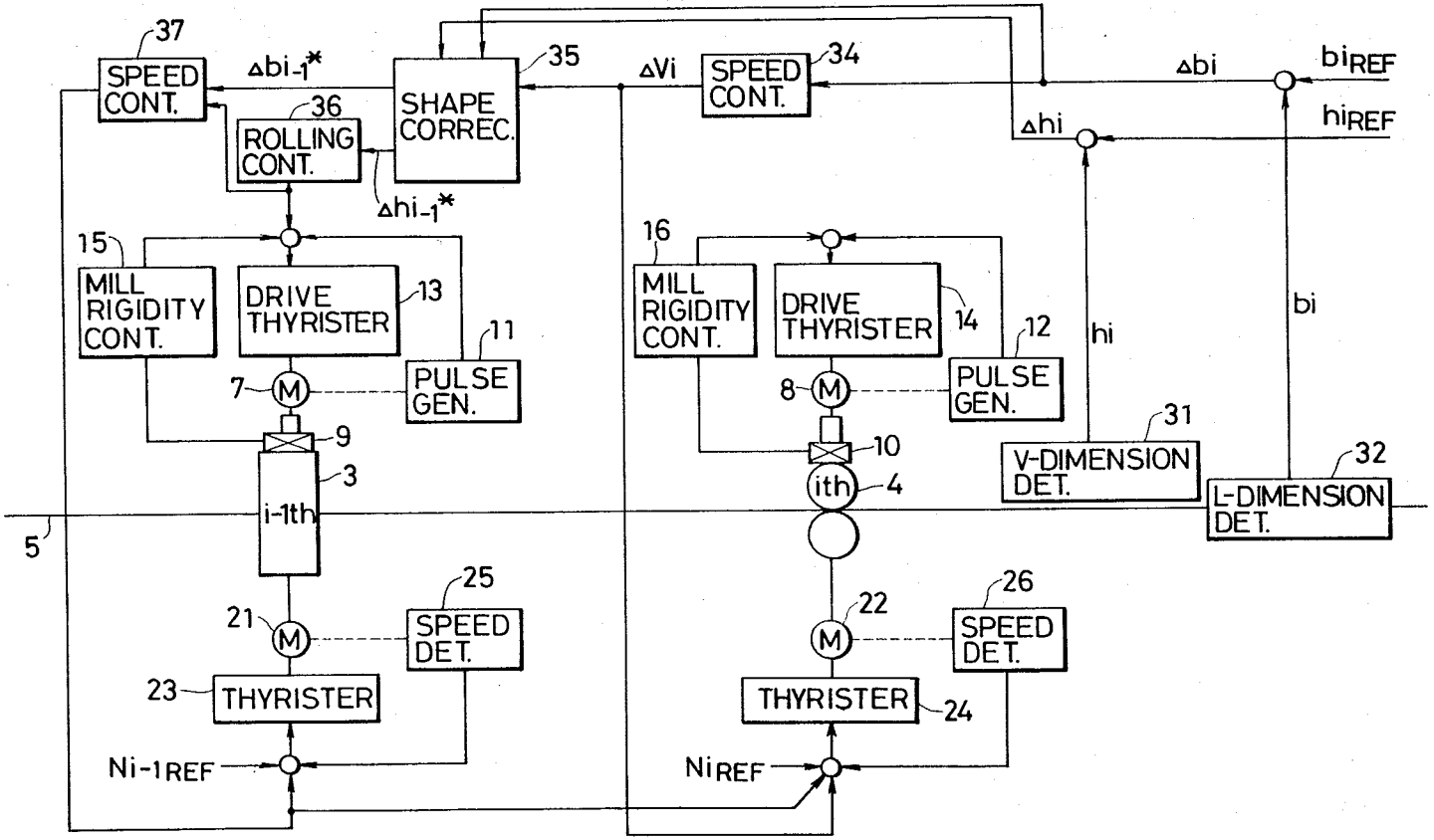
FIG. 2 is a block diagram showing a dimension control device of a continuous rolling mill according to one embodiment of this invention.

In FIG. 2 there are shown an i−1th mill stand 3, an ith mill stand 4, a rolling material 5 and rolling drive motors 7, 8 for the respective mill stands. Load cells 9, 10 are mounted on respective mill stands for the detection of rolling loads, and pulse generators 11, 12 are connected to the rolling drive motors 7, 8, respectively, for the detection of rolling positions. Motor driving thyristors 13, 14 are provided for supplying electric power to the rolling drive motors 7, 8; mill rigidity control devices 15, 16 are provided for respective mill stands, and drive motors 21, 22 are arranged for the rolling rolls of the i−1th mill stand 3 and the ith mill stand 4.

Driving thyristors 23, 24 are provided for the respective motors 21, 22, and speed detectors 25, 26 are disposed for speed detection of the drive motors. A vertical dimension detector 31 for the detection of the vertical dimension of the material at the exit of the ith mill stand 4 and a lateral dimension detector 32 for the detection of the lateral dimension of the material are arranged at the exit of the ith mill stand 4. A difference Δbi between the lateral dimension bi detected by the lateral dimension detector 32 and a reference lateral dimension biREF is supplied to the speed control device 34 to control the rolling speed of the ith mill stand. Further, a difference Δhi between the vertical dimension hi detected by the vertical dimension detector 31 and a reference vertical dimension hiREF at the exit of the ith mill stand is supplied to a shape correction device 35.

In FIG. 2, the shape correction device 35 receives dimensional changes Δhi, Δbi of the material at the exit of the ith mill stand, and the control output ΔVi from the speed control device 34 and calculates such a change value Δhi−1* in the vertical dimension and a change value Δbi−1* in the lateral dimension of the i−1th mill stand 3 as will reduce the change Δbi to zero in accordance with a predetermined algorithm. A rolling control device 36 corrects the rolling position of the i−1th mill stand in accordance with the change value Δhi−1* in the vertical dimension calculated by the shape correction device, and a speed control device 37 corrects the speed of the drive motor 21 driving the i−1th mill stand in accordance with the change value Δbi−1* in the lateral dimension, as calculated by the shape correction device 35.

The control system of this embodiment of the invention will now be explained.

The rolling speed of the ith mill stand is controlled in order to control the lateral dimension of the material at the exit of the ith mill stand 4 in this invention and the reason therefor will firstly be described.

Figure 3B:
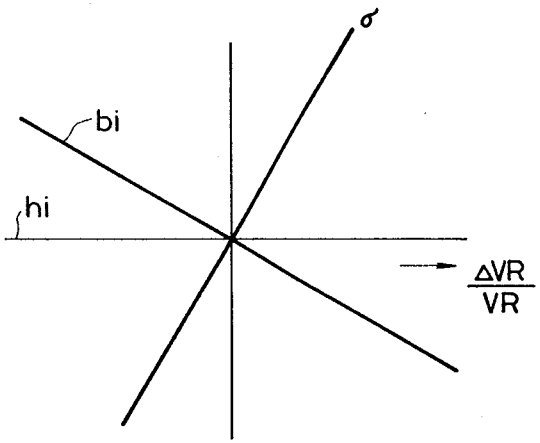
FIGS. 3(*a*) and 3(*b*) are characteristic diagrams showing the relationships between the rolling position and the speed of the rolling mill and the vertical and lateral dimensions.
Figure 3A:
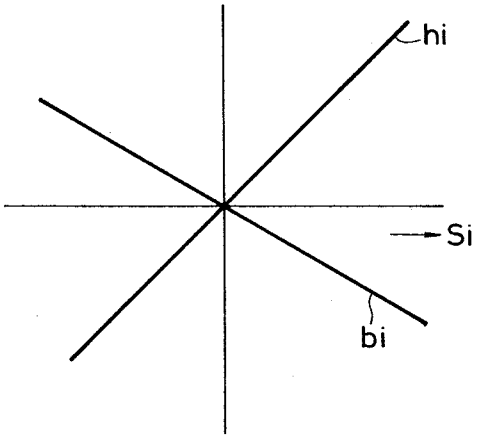

FIG. 3(*a*) shows changes in the vertical dimension hi and the lateral dimension bi of the rolling material 5 at the exit of the ith mill stand 4 in the case where the rolling position Si of the ith mill stand 4 is changed, and FIG. 3(*b*) shows the change in the tension α between the i−1th mill stand and the ith mill stand as well as changes in the vertical dimension hi and the lateral dimension bi of the rolling material at the exit of the ith mill stand 4 in the case where the speed ΔVR/VR of the ith mill stand 4 is changed. As can been seen from FIG. 3(*b*), a change in the speed of the ith mill stand 4 causes no substantial change in the vertical dimension hi, with only the lateral dimension bi being changed. Accordingly, in order to change the vertical dimension hi at the exit of the ith mill stand 4, it is necessary to control the rolling position Si of the ith mill stand 4.

However, control of the rolling position Si for the ith mill stand also causes the lateral dimension bi to be changed and, therefore, the rolling position Si cannot be solely controlled. On the contrary, as can be seen from FIG. 3(*b*), if the lateral dimension of the material at the exit of the ith mill stand is controlled by controlling the rolling speed ΔVR/VR of the ith mill stand, this has no substantial effect on the vertical dimension hi. Accordingly, the lateral dimension can be controlled satisfactorily by controlling the speed of the ith mill stand to thereby control the tension between the i−1th mill stand and the ith mill stand.

Specifically, the difference Δbi between the lateral dimension bi detected by the lateral dimension detector 32 disposed at the exit of the ith mill stand 4 and a reference lateral dimension biREF at the exit of the ith mill stand is supplied to the speed control device 34. The speed control device 34 generates such a speed correction signal ΔVi as will reduce the change Δbi in the lateral dimension at the exit of the ith mill stand based on the relation shown in FIG. 3(*b*) to zero, and thereby controls the speed of the motor 22 for driving the ith mill stand 4. That is, the speed correction signal ΔVi generated by the speed control device 34 is inputted, together with a reference speed signal NiREF of the ith mill stand, to the thyristor 24. The thyristor 24 controls the speed of the motor 22 in accordance with the speed signal thus input. Then, speed control is continued until the feedback signal from the speed detector 26 agrees with the speed signal inputted to the thyristor 24.

By the way, the speed of the ith mill stand is corrected by the speed control device 34 as described above, but, if the correction amount is too great, this may increase the tension (or compressive force) between the i−1th mill stand and the ith mill stand excessively, thereby resulting in the risk of twisting or buckling the rolling material 5. In order to avoid such danger, dimensional differences Δhi, Δbi of the rolling material at the exit of the ith mill stand and the speed correction amount ΔVi for the ith mill stand are inputted to the shape correction device 35 for the i−1th mill stand and, in order to change the shape of the rolling material at the exit of the i−1th mill stand, a correction for rolling and for the speed are applied to the rolling control device 36 and the speed control device 37 for the i−1th mill stand.

The operation of the shape correction device 35 for the i−1th mill stand will be explained.

The shape correction device 35 for the i−1th mill stand is provided with dimensional changes Δhi, Δbi of the rolling material at the exit of the ith mill stand 4 and calculates such a change value Δhi−1* in the vertical dimension and a change value Δbi−1* in the lateral dimension of the rolling material at the exit of the i−1th mill stand as will reduce the dimensional changes to zero. While various forms of calculation algorithms may be considered depending on the characteristics of the rolling mills, two non-limitative examples are described herein.

As one example of the calculation algorithm, a change value Δhi−1* in the vertical dimension and a change value Δbi−1* in the lateral dimension at the exit of the i−1th mill stand are calculated so that the change Δhi in the vertical dimension and the change Δbi in the lateral dimension at the exit of the ith mill stand are reduced to zero:

$$\Delta bi\text{-}1^* = \frac{-1}{\frac{\alpha hi}{\alpha bi\text{-}1}} \cdot \Delta hi \tag{1}$$

$$\Delta hi\text{-}1^* = \frac{-1}{\frac{\alpha bi}{\alpha hi\text{-}1}} \cdot \left( \Delta bi - \frac{\alpha bi}{\alpha bi\text{-}1} \cdot \Delta bi\text{-}1^* \right) \tag{2}$$

where $$\frac{\alpha hi}{\alpha bi\text{-}1}$$

represents an effect coefficient of the change in the lateral dimension of the rolling material at the exit of the i−1th mill stand relative to the vertical dimension of the rolling material at the exit of the ith mill stand, $$\frac{\alpha bi}{\alpha hi\text{-}1}$$

represents an effect coefficient of the change in the vertical dimension of the rolling material at the exit of the i−1th mill stand relative to the lateral dimension of the rolling material at the exit of the ith mill stand, and $$\frac{\alpha bi}{\alpha bi\text{-}1}$$

represents an effect coefficient of the change in the lateral dimension of the rolling material at the exit of the i−1th mill stand relative to the lateral dimension to the rolling material at the exit of the ith mill stand.

As another example of the calculation algorithm, in the case where both of the mill rigidities of the i−1th and ith mill stands are sufficiently high and the change Δhi in the vertical dimension is not so large and thus the rolling change ΔSi is not high, correction for the shape at the exit of the i−1th mill stand is reduced to zero. Δbi is changed by a change in any one of the dimensions hi, bi of the rolling material at the exit of the i−1th mill stand and the ratio for each of the changes: $\alpha=\Delta hi-1^*/\Delta bi-1^*$ is controlled to a constant value. The change for Δhi−1, Δbi−1 are calculated as below:

$$\Delta bi = \frac{\alpha bi}{\alpha bi\text{-}1} \cdot \Delta bi\text{-}1 + \frac{\alpha bi}{\alpha bi\text{-}1} \cdot \Delta hi\text{-}1 \tag{3}$$

where $$\frac{\alpha bi}{\alpha bi\text{-}1}, \frac{\alpha bi}{\alpha hi\text{-}1}$$

represent effect coefficients incorporated in equations (1), (2), and $$\Delta hi-1^* = \alpha \cdot \Delta bi-1^* \tag{4}$$

By substituting equation (4) into equation (3) with the sign of the instruction value being reversed, Δbi−1* is calculated as:

$$\Delta bi\text{-}1^* = \frac{-1}{\frac{\alpha bi}{\alpha bi\text{-}1} + \alpha \cdot \frac{\alpha bi}{\alpha hi\text{-}1}} \cdot \Delta bi \tag{5}$$

The change Δbi−1* is calculated in equation (5) and the change Δhi−1* is calculated in equation (4).

if $\alpha=0$, only Δbi−1* is changed and if $\Delta=hi-1/bi-1$, the ellipse ratio of the shape at the exit of the i−1th mill stand is made constant.

The shape correction device 35 for the i−1th mill stand may be operated such that the device is actuated only when the rolling correction amount ΔSi for the ith mill stand and the speed correction amount ΔVi for the ith mill stand, which are monitored, meet certain limits, or the device may always be actuated irrespective of the values ΔSi, ΔVi. Then, the outputs Δhi−1*,Δbi−1* from the shape correction device 35 for the i−1th mill stand are respectively input to the rolling control device 36 and the speed control device 37 for the i−1th mill stand.

The rolling control device 36 for the i−1th mill stand calculates the change in the rolling amount based on Δhi−1* according to equation (6):

$$\Delta Si\text{-}1 = \frac{1}{\frac{\alpha hi\text{-}1}{\alpha Si\text{-}1}} \cdot \Delta hi\text{-}1^* \tag{6}$$

where αhi−1/αSi−1 represents an effect coefficient of the change in the rolling amount of the i−1th mill stand relative to the change in the vertical dimension of the rolling material at the exit of the i−1th mill stand.

Further, the speed control device 37 for the i−1th mill stand calculates the speed variation ΔVi′ based on Δbi−1* according to equation (7):

$$\Delta Vi\text{-}1' = \frac{1}{\frac{\alpha bi\text{-}1}{\alpha Vi\text{-}1}} \cdot \Delta bi\text{-}1^* \tag{7}$$

where αbi−1/αVi−1 represents an effective coefficient of the speed variation of the i−1th mill stand relative to the change in the lateral dimension of the rolling material at the exit of the i−1th mill stand.

Then, since the lateral dimension at the exit is also changed by the change in the rolling amount, the speed variation ΔVi−1″ resulting from the change in the rolling amount of the i−1th mill stand is calculated according to equation (8):

$$\Delta Vi\text{-}1'' = \frac{\alpha bi\text{-}1}{\alpha Si\text{-}1} \cdot \Delta Si\text{-}1 \tag{8}$$

where αbi−1/αSi−1, αbi−1/αVi−1 represent effect coefficients concerning the i−1th mill stand, specifically, the change of the rolling position and speed change relative to the lateral dimension.

Both ΔVi−1′ and ΔVi−1″ are added as a speed variation ΔVi−1 for the i−1th mill stand, by which the speeds for the i−1th and ith mill stands are corrected to thereby change the tension before the i−1th mill stand.

In this way, the rolling amount and the speed of the i−1th mill stand are corrected so that the output values of the shape correction device 35 at the exit of the i−1th mill stand are Δhi−1*, Δbi−1* respectively.

While it is necessary to previously determine the effect coefficients $$\left(\frac{\alpha hi}{\alpha hi\text{-}1}, \frac{\alpha bi}{\alpha hi\text{-}1}, \frac{\alpha bi}{\alpha hi\text{-}1}, \frac{\alpha hi\text{-}1}{\alpha Si\text{-}1}, \frac{\alpha bi\text{-}1}{\alpha Vi\text{-}1}, \frac{\alpha bi\text{-}1}{\alpha Si\text{-}1}\right)$$

for the control of the i−1th mill stand, these can be measured empirically. Further, if there are errors in the coefficients, they do not lead to errors in the final dimension and the shape since feedback control is applied at the exit of the ith mill stand by the dimension detector.

In the above embodiment, although the vertical dimension detector 31 is disposed at the exit of the ith mill stand 4 and the change Δhi in the vertical dimension of the material at the exit of the ith mill stand or the like is inputted to the shape correction device 35 to calculate the change value Δhi−1* in the vertical dimension and the change value Δbi−1* in the lateral dimension at the i−1th mill stand, the vertical dimension detector 31 may be omitted, and the shape correction device 35 can be adapted to calculate Δhi−1* and Δbi−1* based on the change Δbi in the lateral dimension and the control amount ΔVi from the speed control device 34.

Further, in the above embodiment, although the speeds of the i−1th and ith mill stands are changed in order to change the tension between the i−2th mill stand and the i−1th mill stand, and the speed for the ith mill stand is changed in order to change the tension between the i−1th mill stand and the ith mill stand, the speed of the i−2th mill stand and the speeds of the i−2th, i−1th mill stands may, alternatively, be changed. Basically, it is required only that the tension between the i−2th mill stand and the i−1th mill stand, as well as the tension between the i−1th mill stand and the ith mill stand can be controlled.

Figure 4:
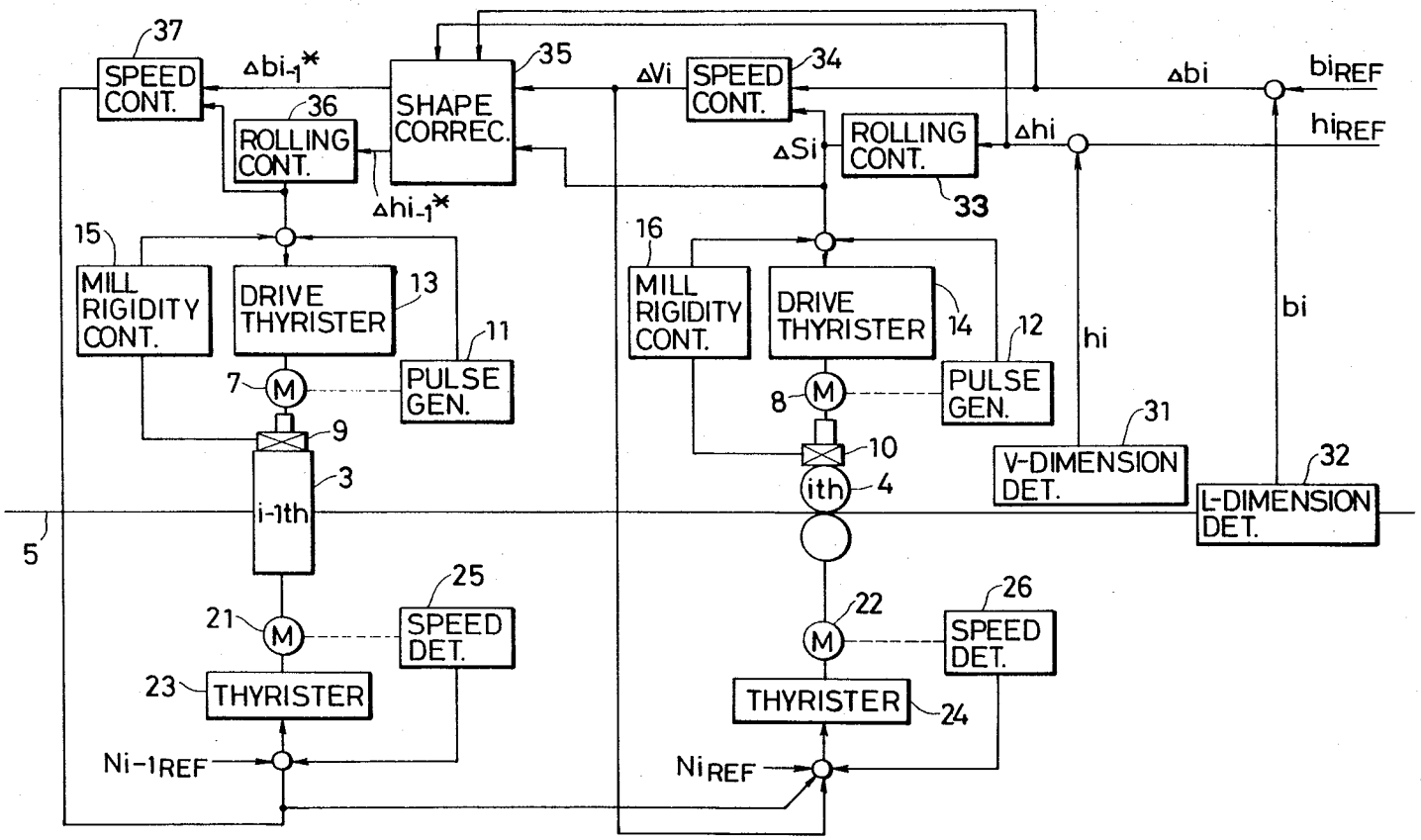
FIG. 4 is a block diagram of a second embodiment of the invention.

In a second embodiment of the invention shown in FIG. 4, the arrangement is similar to that of FIG. 2, however the respective differences Δhi, Δbi between the vertical dimension hi and lateral dimension bi as detected by the vertical dimension detector 31 and the lateral dimension detector 32 and their reference values hiREF, biREF are supplied to a rolling control device 33 and the speed control device 34 respectively, to thereby control the rolling position and the speed of the ith mill stand. In FIG. 4 are also shown the shape correction device 35 that receives outputs from the rolling control device 33 and the speed control device 34, and calculates the dimensional change value Δhi−1* in the vertical dimension and a change value Δbi−1* in the lateral dimension in the i−1th mill stand 3 such as will reduce the values Δhi and Δbi to zero in accordance with a predetermined algorithm. The remaining elements are equilavent to those shown in FIG. 2.

With respect to FIGS. 3(*a*) and 3(*b*) described above, the present embodiment takes notice of the fact that while the lateral dimension bi changes, the vertical dimension hi does not substantially change at the exit of the ith mill stand in the case where the speed for the ith mill stand is changed, and effects control of the speed of the ith mill stand in order to cancel the change in the lateral dimension bi resulting from the correction of the rolling position of the ith mill stand.

The control operation of this embodiment will now be described more specifically.

(1) Control of the Vertical Dimension

The difference signal Δhi between the vertical dimension hi of the material at the exit of the ith mill stand 4 detected by the vertical dimension detector 31 and the reference vertical dimension hiREF is supplied to the rolling control device 33. The rolling control device 33 applies PI control by calculating a rolling position correction signal ΔSi for the ith mill stand such as will reduce the inputted change Δhi in the vertical dimension to zero based on the characteristic shown in FIG. 3(*a*). The rolling position correction signal ΔS derived from the rolling control device 33 is supplied to the rolling device for the ith mill stand comprising the thyristor 14, the rolling drive motor 8 and the pulse generator 12 to correct the rolling position. The correction for the rolling position is carried out until the rolling position for the ith mill stand detected by the pulse generator 12 agrees with the rolling position correction signal. PI control with the rolling control device 33 may be performed in either a continuous rolling or in a sampling fashion.

The mill rigidity control devices 15, 16 apply mill rigidity control (BISRA control) due to the rolling loads detected by the load cells 9, 10 and the object of this control device is to decrease the effect of transmitting dimensional change at the inlet to the exit in each of the mill stands. In this case, where the rolling mill has sufficient rigidity, mill rigidity control is unnecessary.

The lateral dimension is changed by applying control over the vertical dimension as described above, and the dimensional change is compensated by control of the lateral dimension as described below.

(2) Control of the Lateral Dimension

By correcting the rolling position in the control of the vertical dimension, the lateral dimension is also changed.

Specifically, the change bi in the lateral dimension due to the change Si in the rolling position can be represented as:

$$\Delta bi = \frac{\delta bi}{\delta Si} \cdot \Delta Si \tag{9}$$

where δbi/δSi represents an effect coefficient of the change in the rolling position relative to the lateral dimension.

The lateral change represented by equation (9) can be cancelled by controlling the speed of the stand.

The change in the lateral dimension relative to the change ΔVi in the stand speed can be represented as:

$$\Delta bi = \frac{\delta bi}{\delta Vi} \cdot \Delta Vi \tag{10}$$

Accordingly, the change in the rolling position represented by equation (9) can be represented according to equations (9) and (10) as:

$$\Delta Vi = \frac{\delta bi}{\delta Si} \cdot \frac{1}{\frac{\delta bi}{\delta Vi}} \cdot \Delta Si \tag{11}$$

By applying speed correction to the ith mill stand based on equation (11), the change in the lateral dimension resulting from the correction of the rolling position carried out in the control for the vertical dimension may be eliminated.

However, if the value of the effect coefficient in equation (11) is not adequate, or the lateral dimension is changed due to a reason other than the change in the lateral dimension resulting from the correction of the rolling position, the change in the lateral dimension can not be compensated completely.

In order to avoid this, the speed control device 34 applies speed correction of the ith mill stand 4, for example, by way of PI control based on the difference Δbi between the actually measured value of the lateral dimension at the exit of the ith mill stand by the lateral dimension detector 32 and the reference value biREF of the lateral dimension. By incorporating a control integration factor (I factor), a speed correction signal as will cause the lateral dimension to agree with the reference value biREF can be output. That is, the speed control device 34 carries out speed correction based on equation (11) and the feed back control for the lateral dimension simultaneously.

The speed correction signal ΔVi output from the speed control device 34 is added to the reference speed NiREF of the ith mill stand, and inputted to the thyristor 24 for controlling the speed of the motor 22 for the ith mill stand to change the speed thereof and thus control the tension between the i−1th mill stand and the ith mill stand to thereby compensate the change in the lateral dimension.

By the control over the vertical dimension and lateral dimension as described, both the vertical and lateral dimensions can be controlled so as to agree with the reference values.

(3) Control of the i−1th Mill Stand

The rolling and the speed of the i−1th mill stand are corrected by the rolling control device 33 and the speed control device 34 as described above. However, if the correction amounts are too great, they result in excessively large changes in the rolling torque and the rolling pressure with respect to the rolling and increase the inter-stand tension (or compressive force) excessively with respect to the speed thereby resulting in a risk of twisting or buckling the rolling material. In order to avoid this, the dimensional differences Δhi, Δbi of the rolling material at the exit of the ith mill stand and the rolling and speed correction amounts ΔSi, ΔVi for the ith mill stand are inputted to the shape correction device 35 for the i−1th mill stand, and correction for rolling and speed are applied to the rolling control device 36 and the speed control device 37 for the i−1th mill stand in order to change the shape of the rolling material at the exit of the i−1th mill stand.

The operation of the shape correction device 35 for the i−1th mill stand is similar to that described heretofore in the previous embodiment. That is, the dimensional changes Δhi, Δbi of the rolling material at the exit of the ith mill stand 4 are inputted to the shape correction device 35 for the i−1th mill stand, and the device calcualtes such a change value hi−1* in the vertical dimension and a change bi−1* in the lateral dimension of the rolling material at the exit of the i−1th mill stand as reduces the dimensional change to zero.

Figure 5:
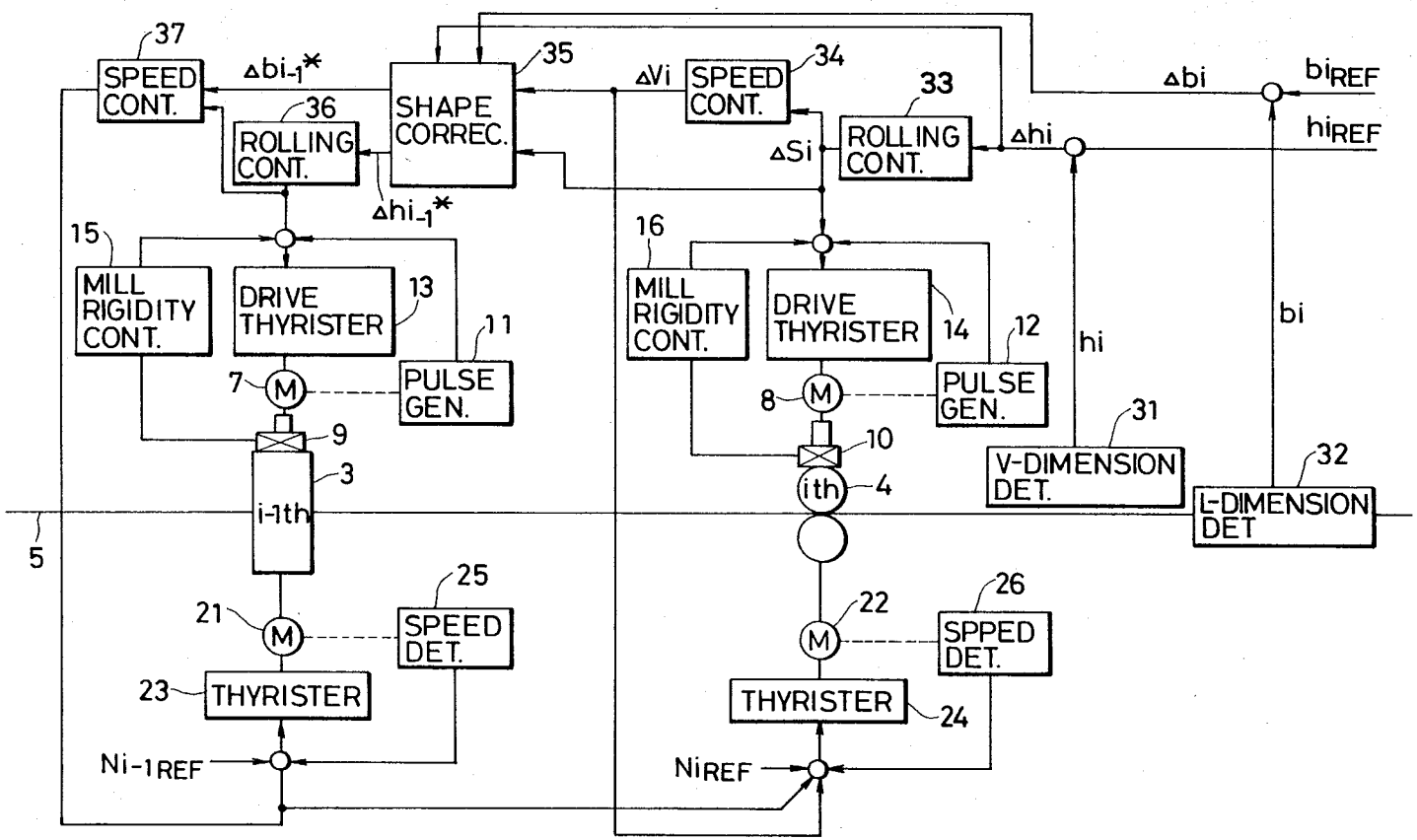
FIG. 5 is a block diagram of a further modification of the invention.

In a third embodiment of the invention illustrated in FIG. 5, the difference Δbi between the lateral dimension bi detected by the lateral dimension detector 32 and a reference lateral dimension biREF is supplied to the shape correction device 35. Further, the difference Δhi between the vertical dimension hi and the reference value hiREF is supplied to the rolling control device 33 to control the rolling position of the ith mill stand. Also shown are a speed control device 34 receiving a control value ΔSi for the rolling position of the rolling control device 33 and acting to correct the rolling speed of the ith mill stand in order to compensate the change in the lateral dimension of the material at the exit of the ith mill stand resulting from the rolling control. The shape correction device 35, as in previous embodiments, receives the control outputs from the rolling control device 33 and the speed control device 34, and changes Δhi and Δbi in the dimensions of the material at the exit of the ith mill stand 4, and delivers a change value Δhi−1* in the vertical dimension and a change value Δbi−1* in the lateral dimension of the i−1th mill stand 3 such as will reduce the change Δhi to zero in accordance with a predetermined algorithm, the previously described algorithms being mentioned as examples.

The remaining elements numbered similarly to those in in FIGS. 2 and 4 perform the same or equivalent functions.

One of the features of this invention is to estimate and compensate the change in the lateral dimension of the rolling material when the rolling position is changed vertically. Specifically, the vertical dimension of a rolling material 5 is detected by the vertical dimension detection device 31 disposed at the exit of the ith mill stand 4 and the rolling position of the mill stand 4 is changed so that the detected dimension may agree with the reference vertical dimension hiREF. However, in a rolling mill of this type, the lateral dimension of the rolling material 5 is changed by this change in the rolling position. In order to avoid this, the tension between the upstream stands is controlled by changing the rolling speed as well as the rolling position of the stand to thereby compensate the change in the lateral dimension.

The reason for controlling the speed as well as the rolling position of the stand was explained previously by way of FIG. 3.

FIG. 3(*a*) shows changes in the vertical dimension hi and the lateral dimension bi at the exit of the ith mill stand in the case where the rolling position Si for the ith mill stand 4 is changed, and FIG. 3(*b*) shows a change in the tension between the i−1th mill stand 3 and the ith mill stand 4, as well as changes in the vertical dimension hi and the lateral dimension bi at the exit of the ith mill stand 4 in the case where the speed ΔVR/VR for the ith mill stand 4 is changed. As can be seen from FIG. 3(*b*), change in the speed for the ith mill stand 4 causes no substantial change in the vertical dimension hi at the exit of the ith mill stand 4 with only the lateral dimension bi being changed.

Accordingly, in order to change the vertical dimension hi at the exit of the ith mill stand 4, it is necessary to control the rolling position Si for the ith mill stand 4.

Taking note of the fact that the lateral dimension bi changes greatly while the vertical dimension hi does not change substantially at the exit of the ith mill stand 4 in the case where the speed of the ith mill stand 4 is changed, the speed of the ith mill stand 4 is controlled in order to cancel the change in the lateral dimension bi resulting from the correction of the rolling position of the ith mill stand.

The control means according to this embodiment will now be explained more specifically.

In FIG. 5, if the rolling position of the ith mill stand is changed so as to attain the relation: Δhi=0, the vertical dimension of the rolling material 5 agrees with the reference value.

The difference Δhi between the vertical dimension hi of the rolling material measured by the vertical dimension detection device 31 and the reference vertical dimension hiREF is inputted to the rolling control device 33 to calculate a difference signal ΔSi for the rolling position, which is outputted to the rolling device for the ith mill stand comprising the thyristor 14, the rolling drive motor 8 and the pulse generator 12, for instance, under PI control so as to reduce the difference Δhi to zero. PI control as applied by the rolling control device 33 may be performed either in a continuous or sampling manner.

The motor driving thyristor 14 drives the rolling drive motor 7 using the rolling position difference signal ΔSi until the rolling position signal detected by the pulse generator 12 agrees with the rolling position difference signal.

The mill rigidity control devices 15, 16 apply mill rigidity control (BISRA control) in the manner described in connection with the second embodiment. Where the rolling mills have sufficient rigidity, mill rigidity control is not necessary.

The lateral dimension is of course changed by applying the control over the vertical dimension as described above; and the dimensional change is compensated by control of the lateral dimension as described below.

Assuming the lateral dimension is represented by bi, the change therein as Δbi, the inter-stand tension as $\sigma$, the change therein as $\Delta\sigma$ and the average deformation resistance as km, the change in the lateral dimension and the change in the interstand tension due to the change in the rolling position can be represented as:

$$\frac{\Delta bi}{bi} = \frac{\partial bi}{\partial Si} \cdot \frac{\Delta Si}{Si} \quad (12)$$

$$\frac{\Delta \sigma}{Km} + \frac{\partial \sigma}{\partial Si} \cdot \frac{\Delta Si}{Si} \quad (13)$$

where $$\frac{\partial bi}{\partial Si} \cdot \frac{\partial \sigma}{\partial Si}$$

represents an effect coefficient of the change in the rolling position relative to the lateral dimension bi of the material and to the inter-stand tension $\sigma$, respectively.

The lateral change represented by equation (12) can be cancelled by controlling the speed of the stand. Specifically the changes in the lateral dimension of the material and in the inter-stand tension relative to the variation in the stand speed VR can be represented as:

$$\frac{\Delta bi}{bi} = \frac{\partial bi}{\partial VR} \cdot \frac{\Delta VR}{VR} \quad (14)$$

$$\frac{\Delta \sigma}{km} = \frac{\partial \sigma}{\partial VR} \cdot \frac{\Delta VR}{VR} \quad (15)$$

Accordingly, the variation in the stand speed sufficient to cancel the change in the lateral dimension relative to the change Si/Si in the rolling position represented by equation (12) can be represented according to equations (12), (14) as:

$$\frac{\Delta VR}{VR} = \frac{\partial VR}{\partial bi} \cdot \frac{\partial bi}{\partial Si} \cdot \frac{\Delta Si}{Si} \quad (16)$$

That is, the change in the lateral dimension can be eliminated by varying the speed of the stand by an amount ΔVR/VR for the given change ΔSi/Si of the rolling position.

The speed control device 34 shown in FIG. 5 applies speed control to the stand, for instance, by way of PI control based on the value determined by equation (14). The speed control device 34 receives the rolling position difference signal ΔSi from the rolling control device 33, calculates the speed correction signal ΔVi based on equation (16) and corrects the speed of the motor 22 that drives the ith mill stand 4. Specifically, a speed signal prepared by adding the speed correction signal ΔVi to the speed reference signal NiREF of the motor 22 is supplied to the thyristor 24, which drives the motor 22 in accordance with the speed signal thus applied. The detection device 26 feeds back the speed of the motor 22.

The rolling value and the speed of the ith mill stand are corrected by the rolling control device 33 and the speed control device 34 as described above. However, if the correction amounts are too large, this results in excessively large changes in the rolling torque and rolling pressure as mentioned previously, thereby bringing about a risk of twisting or buckling the rolling material. In order to avoid such a danger, the dimensional differences Δhi, Δbi of the rolling material at the exit of the ith mill stand and the correction amounts ΔSi, ΔVi of the rolling amount and the speed of the ith mill stand are inputted to the shape correction device 35 for the i−1th mill stand, and corrections for rolling and the speed are applied to the rolling control device 36 and the speed control device 37 for the i−1th mill stand in order to change the shape of the rolling material at the exit of the i−1th mill stand. The manner of operation of the device 35 and the i−1th mill stand are as described above, the shape correction device 35 calculating such a change value Δhi−1* in the vertical dimension and a change Δbi−1* in the lateral dimension of the rolling material at the exit of the i−1th mill stand as will reduce the dimensional changes to zero, using a suitable calculation algorithm.

In the above embodiment, although the lateral dimension detector 32 is disposed at the exit of the ith mill stand 4 and the change Δbi in the lateral dimension of the rolling material at the exit of the ith mill stand or the like is inputted to the shape correction device 35 to calculate the change values Δhi−1* and Δbi−1* in the lateral dimension of the i−1th mill stand, the lateral dimension detector 32 may be omitted and the changes Δhi−1* and Δbi−1* may be calculated in the shape correction device 35 based on the change Δhi in the vertical dimension and the control amounts or values ΔSi, ΔVi from the rolling control device 33 and the speed control device 34.

As described above, according to this invention, since the lateral dimension of the material at the exit of the ith mill stand is detected and the tension of the material between the i−1th mill stand and the ith mill stand is controlled so the difference between the detected dimension and a reference lateral dimension is reduced to zero, rolling can be performed with dimensional accuracy. In addition, since the above control is combined with a calculation of a change value in the vertical dimension and in the lateral dimension at the i−1th mill stand such as will reduce the change in the lateral dimension at the exit of the i−1th mill stand for the control of the rolling position of the i−1th mill stand and the tension in the material between the i−2th mill stand and the i−1th mill stand, smooth rolling can be performed at high dimensional accuracy with no danger of twisting or buckling the rolling material.

Also, according to this invention, since the vertical dimension and the lateral dimension of a material at the exit of the ith mill stand are detected and the rolling position of the ith mill stand and the tension between the i−1th mill stand and the ith mill stand are controlled so that the detected value may agree with reference dimensions while, at the same time such change values in the vertical dimension and in the lateral dimension of the material at the exit of the i−1th mill stand are derived as will reduce the vertical dimension and the lateral dimension of the material at the exit of the ith mill stand to be identical with the reference dimensions, and controlling the rolling position of the i−1-th mill stand and the tension of the material between the i−2th mill stand and the i−1th mill stand in accordance with the delivered values, rolling can be performed at an extremely high dimensional accuracy.

As described above, according to this invention, since the lateral dimension of the material at the exit of the ith mill stand is measured and the position of the ith mill stand is controlled so as to equate the measured vertical dimension with the reference vertical dimension while, at the same time, compensating the change in the lateral dimension of the material resulting from the rolling control by controlling the tension between the i−1th mill stand and the ith mill stand, dimensional control is possible with high accuracy. In addition, since such a change value in the vertical dimension and a change value in the lateral dimension of the i−1th mill stand are calculated as will render the dimension of the material at the exit of the ith mill stand to be identical with the reference dimension and by controlling the rolling position of the i−1th mill stand and the tension between the i−2th mill stand and the i−1th mill stand in accordance with the calculated values, dimensional control is possible at an extremely high accuracy with neither great changes in the rolling torque rolling pressure nor with excess inter-stand tension (compressive force).

What is claimed is:

1. A control device for a continuous rolling machine, comprising; a lateral dimension detector for detecting a lateral dimension bi of a material at the exit of an ith mill stand, first means receiving a difference Δbi between the detected value bi from said lateral dimension detector and a reference lateral dimension biREF and generating a speed control output directed to speed controls of one or more of the ith, i−1th and i−2th mill stands for controlling the tension between an i−1th mill stand and the ith mill stand so that said difference is reduced to zero, and shape correction means receiving said control output of said first means and said a difference Δbi in the lateral dimension for calculating a change value hi−1* in the vertical dimension and a change value bi−1* in the lateral dimension of the i−1th mill stand as will reduce the difference Δbi to zero in accordance with a predetermined algorithm; rolling control means for controlling the rolling position of the i−1th mill stand in accordance with said change value hi−1* in the vertical dimension as calculated by said shape correction means, and second means generating speed control signals directed to speed controls of one or more of the ith, i−1th and i−2th mill stands for controlling the tension between an i−2th mill stand and the i−1th mill stand in accordance with said change value bi−1* in the lateral dimension as calculated by said shape correction means.

2. A control device for a continuous rolling machine, comprising; vertical dimension detection means and lateral dimension detection means for respectively detecting a vertical dimension hi and a lateral dimension bi of a material at the exit of an ith mill stand; first rolling control means receiving a difference Δhi between detected value hi from said vertical dimension detection means and a reference vertical dimension hiREF and generating a rolling position correction amount for controlling the rolling position of said ith mill stand so that said difference is reduced to zero, first control means receiving said rolling position correction amount of said first rolling control means and a difference Δbi between a detection value bi from said lateral dimension detection device and a reference lateral dimension biREF and generating a speed control output directed to speed controls of one or more of the ith, i−1th and i−2th mill stands for controlling the tension of the material between the ith mill stand and an i−1th mill stand such that the lateral dimension of the material at the exit of the ith mill stand agrees with the reference lateral dimension;

shape correction means receiving said difference Δhi, said difference Δbi, said rolling position correction amount and said speed control output of said first control means, for calculating a change value hi−1* for the vertical dimension and a change value bi−1* for the lateral dimension in the i−1th mill stand such as will reduce said difference Δhi and said difference Δbi to zero in accordance with a predetermined algorithm, second rolling control means for correcting a rolling position of the i−1th mill stand in accordance with said change value hi−1* in the vertical dimension as calculated by said shape correction means, and second control means generating a speed control output directed to speed controls of one or more of the ith, i−1th and i−2th mill stands for correcting the tension of the material between the i−1th mill stand and an i−2th mill stand in accordance with said change value bi−1* in the lateral dimension as calculated by said shape correction means.

3. A control device for a continuous rolling machine, comprising; vertical dimension detection means for measuring a vertical dimension hi of a material at the exit of an ith mill stand, rolling control means receiving a difference Δhi between a detected value hi of said vertical dimension detection device and a reference vertical dimension hiREF and generating a rolling position control amount ΔSi for controlling the rolling position of the ith mill stand so that said difference is reduced to zero, and means receiving said rolling position control amount ΔSi from said rolling control means and generating speed control signals directed to speed controls of one or more of the ith, i−1th and i−2th mill stands for compensating for the change in the lateral dimension of the material at the exit of the ith mill stand relative to said rolling position control amount by controlling the tension of the material between an i−1th mill stand and the ith mill stand.

4. A control device for a continuous rolling machine, comprising; vertical dimension detection means for measuring a vertical dimension hi of a material at the exit of an ith mill stand, first rolling control means receiving a difference Δhi between a detected value hi from said vertical dimension detection device and a reference vertical dimension hiREF and generating a rolling position control amount ΔSi for controlling the rolling position of the ith mill stand so that said difference is reduced to zero, first means receiving said rolling position control amount ΔSi from said first rolling control means and generating a speed control output directed to speed controls of one or more of the ith, i−1th and i−2th mill stands for compensating for the change in the lateral dimension of the material at the exit of the ith mill stand relative to said rolling position control amount by controlling the tension of the material between the i−1th mill stand and the ith mill stand, shape correction means receiving said difference Δhi, said rolling position control amount and said control output from said first means, for calculating a change value hi−1* in the vertical dimension and a change value bi−1* in the lateral dimension of the i−1th mill stand such as will reduce the difference Δhi to zero in accordance with a predetermined algorithm, second rolling control means for controlling the rolling position of the i−1th mill stand in accordance with said change value hi−1* in the vertical dimension as calculated by said shape correction means, and second means generating speed control signals directed to speed controls of one or more of the ith, i−1th and i−2th mill stands for controlling the tension between an i−2th mill stand and the i−1th mill stand in accordance with said change value bi−1* in the lateral dimension as calculated by said shape correction means.

* * * * *